US006892703B2

(12) United States Patent
Magel

(10) Patent No.: US 6,892,703 B2
(45) Date of Patent: May 17, 2005

(54) BOOSTED FUEL INJECTOR WITH RAPID PRESSURE REDUCTION AT END OF INJECTION

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/488,895

(22) PCT Filed: Apr. 3, 2003

(86) PCT No.: PCT/DE03/01098

§ 371 (c)(1),
(2), (4) Date: Mar. 8, 2004

(87) PCT Pub. No.: WO2004/003376

PCT Pub. Date: Jan. 8, 2004

(65) Prior Publication Data

US 2004/0231645 A1 Nov. 25, 2004

(30) Foreign Application Priority Data

Jun. 29, 2002 (DE) ..... 102 29 419

(51) Int. Cl.[7] ..... F02M 37/04
(52) U.S. Cl. ..... 123/446; 123/467; 123/506
(58) Field of Search ..... 123/446, 447, 123/467, 506, 456, 179, 17, 500, 501; 239/88–96

(56) References Cited

U.S. PATENT DOCUMENTS 4,440,132 A * 4/1984 Terada et al. ..... 123/446
4,459,959 A * 7/1984 Terada et al. ..... 123/446
6,446,603 B1 * 9/2002 Bonse et al. ..... 123/446
6,513,497 B1 * 2/2003 Mahr et al. ..... 123/447
6,634,336 B1 * 10/2003 Kropp ..... 123/467
6,688,277 B1 * 2/2004 Mahr et al. ..... 123/299
6,776,138 B2 * 8/2004 Mahr et al. ..... 123/446
6,810,856 B2 * 11/2004 Magel ..... 123/446

FOREIGN PATENT DOCUMENTS

DE 100 40 526 A1 3/2002
EP 0 691 471 A1 1/1996

* cited by examiner

*Primary Examiner*—Carl S. Miller
(74) *Attorney, Agent, or Firm*—Ronald E. Greigg

(57) ABSTRACT

A device for injecting fuel into the combustion chamber of an internal combustion engine including a high-pressure storage chamber, a pressure booster, and a metering valve. The pressure booster includes a work chamber and a control chamber separated from one another by an axially movable piston. A pressure change in the control chamber causes a pressure change in a compression chamber of the pressure booster. The compression chamber acts upon a nozzle chamber in the nozzle body. A pressure relief valve (40) is in a control line between the control chamber of the pressure booster and a 2/2-way metering valve, the pressure relief valve includes a valve body that acts upon at least one hydraulic chamber and can be made to communicate with the pressure prevailing in the high-pressure storage chamber.

16 Claims, 5 Drawing Sheets

BOOSTED FUEL INJECTOR WITH RAPID PRESSURE REDUCTION AT END OF INJECTION

CROSS-REFERENCE TO RELATED APPLICATIONS

This application is a 35 USC 371 application of PCT/DE 03/01098 filed on Apr. 3, 2003.

BACKGROUND OF THE INVENTION

1. Field of the Invention

Both pressure-controlled and stroke-controlled injection system are known for supplying combustion chambers of self-igniting internal combustion engines with fuel. As fuel injection systems, not only unit fuel injectors but also pump-line-nozzle units and storage injection systems are used. Storage injection systems (common rail injection systems) advantageously make it possible to adapt the injection pressure to the load and rpm of the engine. To achieve high specific outputs and to reduce emissions from the engine, the highest possible injection pressure is generally necessary.

2. Prior Art

For reasons of strength, the attainable pressure level in storage injection systems used at present is currently limited to about 1600 bar. To further increase the pressure in storage injection systems, pressure boosters are being used in common rail systems.

European Patent Disclosure EP 0 562 046 B1 discloses an actuation and valve assembly with damping for an electronically controlled injection unit. The actuation and valve assembly for a hydraulic unit has an electrically excitable electromagnet with a fixed stator and a movable armature. The armature has a first and a second surface which define a first and second hollow chamber, and the first surface of the armature points toward the stator. A valve connected to the armature is capable of carrying a hydraulic actuation fluid from a pump to the injection device. A damping fluid can be collected in or drained off from one of the hollow chambers of the electromagnet assembly in accordance with the respective chambers. By means of a region of a valve protruding into a central bore, the fluidic communication of the damping fluid can be selectively opened and closed in proportion to its viscosity.

German Patent Disclosure DE 101 23 910.6 relates to a fuel injection system which is used in an internal combustion engine. The combustion chambers of the engine are each supplied with fuel via fuel injectors which are acted upon via a high-pressure source; the fuel injection system of DE 101 23 910.6 also has a pressure booster, which includes a movable pressure booster piston that divides a chamber which can be connected to the high-pressure source from a high-pressure chamber communicating with the fuel injector. The fuel pressure in the high-pressure chamber can be varied by filling a return chamber of the pressure booster with fuel or by evacuating fuel from this return chamber.

The fuel injector includes a movable closing piston for opening and closing the injection openings that point toward the combustion chamber. The closing piston protrudes into a closing pressure chamber, enabling that chamber to be acted upon by pressure from fuel. As a result, a force urging the closing piston in the closing direction is attained. The closing pressure chamber and a further chamber are formed by a common work chamber; all the portions of the work chamber communicate permanently with one another for exchanging fuel.

With this embodiment, by triggering the pressure booster via the return chamber, it can be attained that the triggering losses in the high-pressure fuel system can be kept slight, compared to triggering via a work chamber that communicates intermittently with the high-pressure fuel source. Moreover, the high-pressure chamber is relieved only down to the pressure level of the high-pressure storage chamber, and not to the leakage pressure level. On the one hand, this improves the hydraulic efficiency of the fuel injector, and on the other, a faster depressurization down to the system pressure level can be accomplished, so that the time intervals between injection phases can be shortened.

With this embodiment, a variable hydraulic closing force which acts on the nozzle needle of the fuel injector is attainable. As a result, a variable nozzle opening pressure is achieved, which increases with the pressure prevailing in the high-pressure storage chamber, so that even at small quantities a high injection pressure is attained, and needle closure can be improved. To realize this hydraulic closing force at little engineering effort or expense, the pressure prevailing in the high-pressure storage chamber is applied directly to the back side of the nozzle needle. To enhance the efficiency, in this version the pressure booster is controlled via the return chamber, which then functions as a pressure booster control chamber. As a result, only the smaller return chamber, but not the large work chamber of the pressure booster, is relieved; in addition, the high-pressure region is relieved only down to the pressure prevailing in the high-pressure storage chamber, and not down to the leakage pressure level; as a result, the hydraulic efficiency of such an arrangement can be improved considerably. This leads to an injection system for self-igniting internal combustion engines with a high attainable injection pressure and simultaneously increased efficiency. For control, however, a 3/2-way valve is necessary, to assure a fast depressurization at the end of injection. In terms of production technology, however, a 3/2-way valve is very complicated to produce and is thus expensive. The requisite tolerances cannot be mastered at present in mass production.

In principle, it is possible for a pressure-boosted fuel injector of the embodiment known from DE 101 23 910.6 to be controlled with a 2/2-way valve in conjunction with a filling throttle. To speed up the restoration and to minimize the quantity lost via the filling throttle, a fill valve can advantageously be employed. When a fill valve is employed, however, a slow pressure drop results at the end of injection, down to the pressure level prevailing in the high-pressure storage chamber, which leads to poor emissions. A rapid pressure drop (rapid spill) is therefore absolutely necessary, if future exhaust gas limit values are to be met. Moreover, a depressurization that proceeds only slowly toward the end of an injection phase has the disadvantage that the mean injection pressure level is decreased considerably.

SUMMARY OF THE INVENTION

The present invention avoids not only the use of a control valve embodied as a 3/2-way valve but also the disadvantages associated with the use of a 2/2-way valve with a filling throttle or fill valve, or in other words a pressure drop that proceeds only slowly toward the end of the injection. With the embodiment proposed according to the invention, the filling throttle and the fill valve are replaced by a pressure relief valve, but by way of it a very fast depressurization can be achieved at the end of an injection event. The fast depressurization (rapid spill) at the end of the injection phase in turn considerably improves the emissions values of the exhaust gas of self-igniting internal combustion engines.

The pressure relief valve is integrated with the control line for relieving the control chamber of the pressure booster. The valve body of the pressure relief valve can not only be embodied as a cylindrical body but can also include a region which can be embodied with a reduced diameter, for instance in the form of a constriction. The face ends of the valve body of the pressure relief valve can not only have equal hydraulically effective surface areas but also different diameters. In the pressure relief valve, two opposed hydraulic chambers can be embodied that communicate with one another through a through bore in the valve body of the pressure relief valve. The flow cross section of the through bore inside the valve body of the pressure relief valve is selected such that a pressure difference builds up between the hydraulic chambers of the pressure relief valve, so that the pressure relief valve can be kept closed.

By using a metering valve embodied as a 2/2-way valve, the use of a 3/2-way valve, which can be produced only in a complex way because of the requisite tolerance and is therefore expensive, can be avoided. Using a pressure relief valve in the control line of the pressure booster makes a fast pressure drop possible at the end of the injection, and as a result fast closure of an injection valve member, embodied for instance as a nozzle needle, can be achieved.

BRIEF DESCRIPTION OF THE DRAWINGS

The invention is described in further detail below in conjunction with the drawing, in which.

DESCRIPTION OF THE PREFERRED EMBODIMENTS

Figure 1:
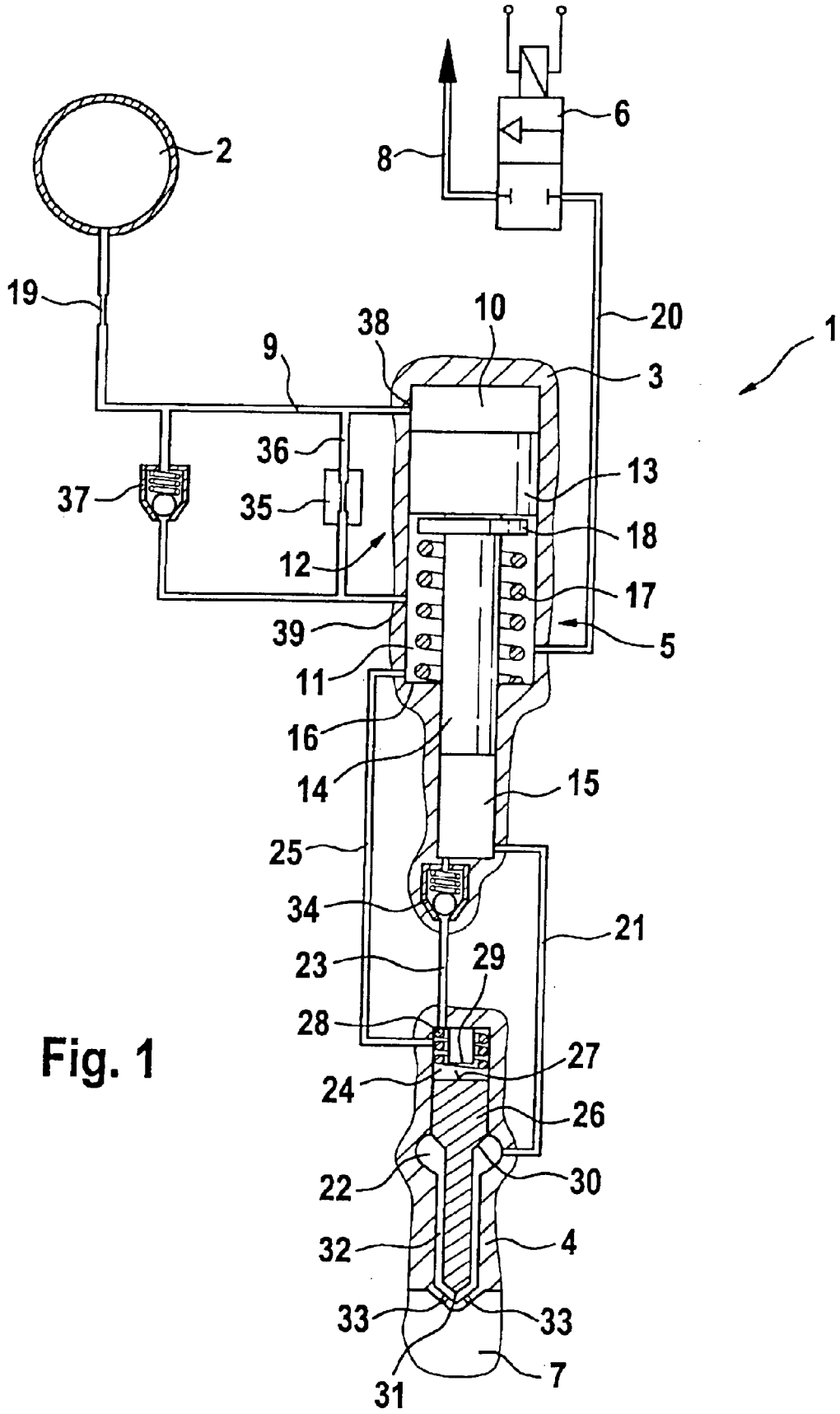
FIG. 1 is a schematic view, partially in section, of a pressure-boosted fuel injector with a fill valve and filling throttle connected parallel to one another and with a slow depressurization behavior.

FIG. 1 shows a prior art pressure-boosted fuel injector, with a parallel-connected fill valve and filling throttle, that has a slow depressurization behavior.

The fuel injection system shown in FIG. 1 includes a fuel injector 1 and a high-pressure storage chamber 2 (common rail). The fuel injector 1 includes an injector body 3, a nozzle body 4, with a pressure booster 5 received in the injector body 3, and a metering valve 6, which in the arrangement shown in FIG. 1 is embodied as a 2/2-way valve. By means of the fuel injector 1, fuel at high pressure is injected into a combustion chamber 7 of a self-igniting internal combustion engine.

From the metering valve 6, a low-pressure-side return 8 extends into a fuel container, not shown, such as the fuel tank of a motor vehicle.

From the high-pressure storage chamber 2 (common rail), fuel at high pressure flows via a supply line 9 into a work chamber 10 of the pressure booster 5. The pressure booster 5 further includes a control chamber 11, which is divided from the work chamber 10 of the pressure booster 5 via a piston 12. The piston 12 of the pressure booster 5 can be embodied in either one piece or multiple parts. In the variant embodiment of FIG. 1, the piston 12 of the pressure booster includes both a first partial piston 13 and a second partial piston 14. The first partial piston 13 is embodied with a first diameter, while by comparison the second partial piston 14, which rests on the first partial piston 13 with the interposition of a restoring spring stop face 18, is embodied with a reduced diameter. A restoring spring 17 is received inside the control chamber 11 of the pressure booster 5; it is braced on one end on an abutment 16, which is formed by the bottom of the control chamber 11 in the injector body 3, and on the other, it rests on the aforementioned restoring spring stop 18. The lower end face of the second partial piston 14 of the piston 12 acts upon a compression chamber 15 of the pressure booster 5, and this chamber in turn, via a fuel inlet 21, carries fuel at high pressure into a nozzle chamber 22 inside the nozzle body 4 of the fuel injector 1.

A throttle restriction 19 can be received in the supply line 9 extending from the high-pressure storage chamber 2 to the work chamber 10 of the pressure booster 5 and serves to damp pressure pulsations in the supply line 9 upon closure and opening of the fuel injector 1; undamped pressure pulsations would result in excessively high pressure peaks in the interior of the high-pressure storage chamber 2. From the supply line 9, which discharges at a discharge point 38 into the work chamber 10 of the pressure booster 5, a throttle branch 36 extends to the work chamber 11 of the pressure booster 5, in which a filling throttle 35 is received. Connected parallel to the throttle branch 36 with the integrated filling throttle 35 is a fill valve 37, which in the variant of a fuel injection system shown in FIG. 1 is embodied as a ball valve with an opening spring. The fill valve 37 is located parallel to the throttle restriction 35 in the throttle branch 36 and discharges into the same line as the throttle branch 36, which in turn discharges into the work chamber 11 of the pressure booster 5.

The control chamber 11 of the pressure booster 5 communicates with the metering valve 6 via a control line 20. From the control chamber 11, a connecting line 25 also branches off and in turn discharges into a nozzle control chamber 24. A closing spring element 28 received in the nozzle control chamber 24 acts upon an upper face end 27 of an injection valve member 26; this valve member can for instance be embodied as a nozzle needle. A stop 29, which is encircled by the closing spring element 28 embodied as a spiral spring, is received inside the nozzle control chamber 24. From the nozzle control chamber 24, a filling line 23 branches off, in which a check valve 34 is received. Via the filling line 23, the compression chamber 15 of the pressure booster 5 is filled with fuel.

The nozzle body 4 of the fuel injector 1 in the arrangement in FIG. 1 includes a nozzle chamber 22, which is supplied with fuel at high pressure from the compression chamber 15 via the fuel inlet 21 already mentioned. The injection valve member 26 includes a pressure shoulder 30, which when a high pressure prevails inside the nozzle chamber 22 moves the injection valve member 26 in the opening direction, counter to the action of the closing spring 28. From the nozzle chamber 22, an annular gap 32 extends inside the nozzle body 4 in the direction of the tip 31 of the injection valve member 26. Via the annular gap 32, the fuel flows to injection openings 33. Via the injection openings 33, the fuel is injected, when the injection valve member 26 is open or in other words has moved out of its seat and away from the combustion chamber of the self-igniting internal combustion engine. As its metering valve 6, the variant of a fuel injection system shown in FIG. 1 uses a 2/2-way valve, which to speed up the restoration and to minimize the outflowing lost quantity is provided with a valve 37 connected parallel to the filling throttle 35. However, the arrangement shown in FIG. 1 has the disadvantage that toward the end of the injection event, a slow pressure drop occurs down to the pressure level prevailing in the high-pressure storage chamber 2 (common rail). This leads to unsatisfactory emissions results; moreover, an only slowly established depressurization lessens the attainable mean injection pressure.

Figure 2:
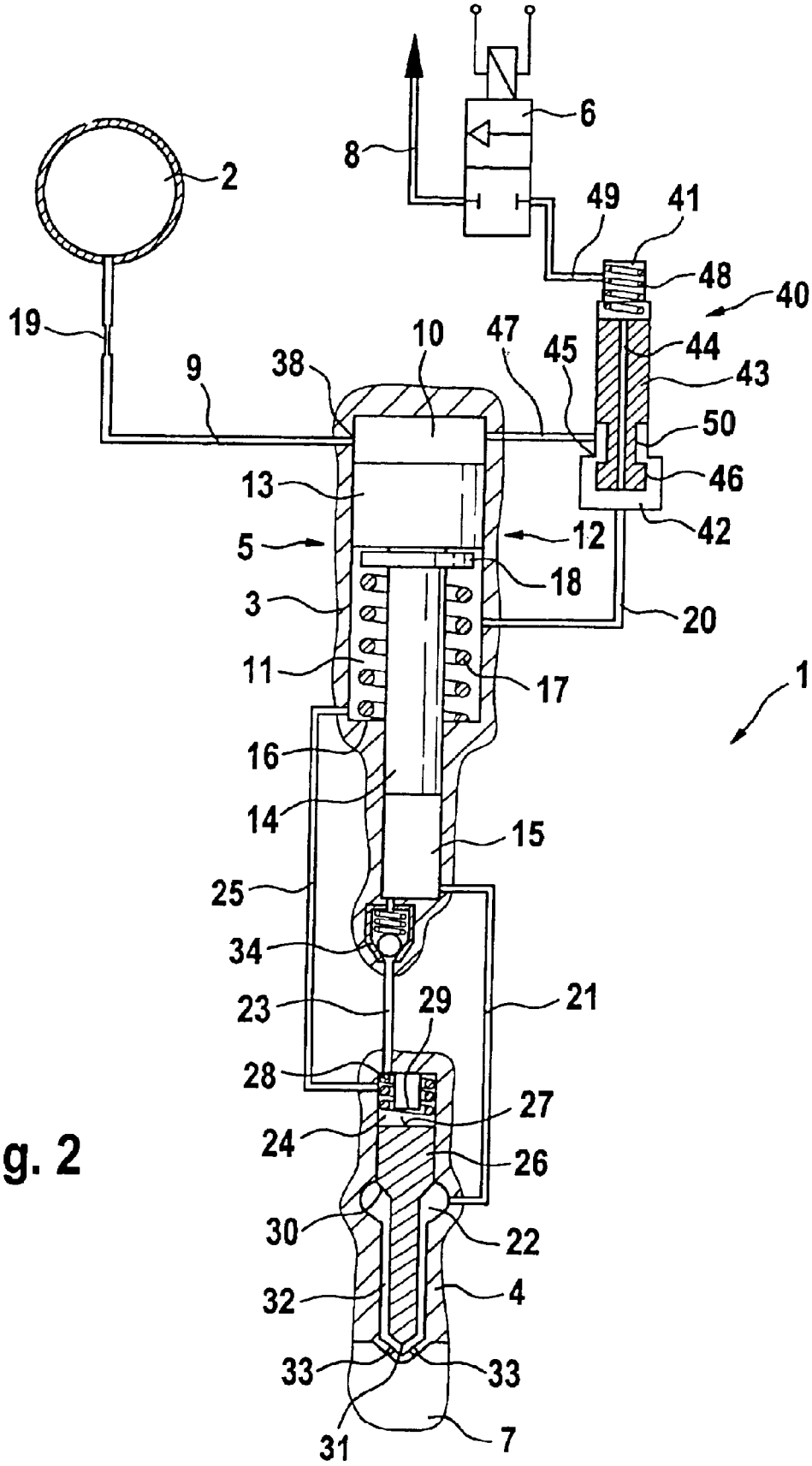
FIG. 2, a pressure-boosted fuel injector according to the invention, with a 2/2-way metering valve and a relief valve in the control line of the control chamber of the pressure booster.

FIG. 2 shows a pressure-boosted fuel injector embodied according to the invention, with a 2/2-way metering valve and a relief valve in the control line for controlling the pressure in the control chamber of the pressure booster.

In the variant embodiment according to the invention of a fuel injection system shown in FIG. 2, a pressure-boosted fuel injector 1 is shown, whose metering valve 6 can be designed as a 2/2-way valve, in whose control line 20 to the control chamber 11 of the pressure booster 5 an additional pressure relief valve 40 is integrated that replaces the filling throttle and the fill valve 37. With this configuration, a fast depressurization (rapid spill) at the end of an injection event can be achieved.

In the state shown in FIG. 2, the system for injecting fuel is in its state of repose. The metering valve 6 embodied as a 2/2-way valve is shown in its closed position. The metering valve 6 can be embodied either as a directly actuated valve or as a servo valve. The metering valve 6 can also be triggered by either a magnetic actuator or a piezoelectric actuator.

It can be seen from the hydraulic circuit diagram in FIG. 2 that the system for injecting fuel includes a high-pressure storage chamber 2 (common rail), which is acted upon by fuel via a high-pressure pump, not shown in FIG. 2, that compresses the fuel to a high pressure level. In the high-pressure storage chamber 2, which is under system pressure, this fuel is stored, so that the fuel system pressure, that is, the pressure prevailing in the interior of the high-pressure storage chamber 2, can be supplied to all the fuel injectors 1, which are present in a number corresponding to the number of cylinders of a self-igniting internal combustion engine. The fuel injector 1 includes the metering valve 6 already mentioned, embodied as a 2/2-way valve; a relief valve 40, received in the control line 20 between the control chamber 11 of the pressure booster 5 and the metering valve 6; the pressure booster 5; and an injection valve member. In the variant embodiment shown in FIG. 2, the pressure booster 5 is embodied as an axially displaceable piston unit, including a piston 12. By means of the piston 12, which may be embodied in one piece or in multiple parts, a work chamber 10 and a control chamber 11 can be separated from one another; the control chamber can be pressure-relieved or acted upon by pressure. The piston 12 of the pressure booster 5 can include a first partial piston 13 and a second partial piston 14. The first partial piston 13 can be embodied with a larger diameter, while the second partial piston 14 is embodied with a reduced diameter by comparison and with its lower face end acts upon a compression chamber 15 of the pressure booster.

From the high-pressure storage chamber 2, a supply line 9 leads to the work chamber 10 of the pressure booster 5; a throttle restriction 19 may be embodied in the supply line 9, in order to damp pressure pulsations or pressure wave reflections that develop in the supply line 9 and their feedback effect into the interior of the high-pressure storage chamber 2. In the state of repose, shown in FIG. 2, of the system for injecting fuel, the metering valve 6, which is preferably designed as a 2/2-way valve, is not triggered, and no injection is taking place. The pressure relief valve 40, received in the control line 20, 49 of the control chamber 11 of the pressure booster 5, is in its open outset state. In the switching state shown in FIG. 2 of the system for injecting fuel, the pressure level prevailing in the interior of the high-pressure storage chamber 2 prevails in the work chamber 10 of the pressure booster 5 and from there, via an overflow line 47, prevails in a second chamber 42 of the pressure relief valve 40 and, via an overflow conduit 44 embodied in a valve body 43 of the pressure relief valve 40, in a first chamber 41 of the pressure relief valve 40. From the second chamber 42 of the pressure relief valve 40, the pressure level prevailing in the high-pressure storage chamber 2 is furthermore present, via the control line 20, in the control chamber 11 of the pressure booster 5, and from there via the connecting line 25 in a nozzle control chamber 24 in the injector body 4, and via a filling line 23 (filling path), the pressure prevailing in the interior of the high-pressure storage chamber 2 is present in the compression chamber 15 of the pressure booster 5.

In the state of repose of the system for injecting fuel, all the pressure chambers of the pressure booster 5, including work chamber 10, control chamber 11 and compression chamber 15 are acted upon by the pressure level prevailing in the high-pressure storage chamber 2. As a result, the piston 12 of the pressure booster 5 is in pressure equilibrium. In the state of repose of the system for injecting fuel shown in FIG. 2, the pressure booster 5 is deactivated, and pressure boosting is not taking place. In this state, the piston 12 of the pressure booster 5, which can include a first partial piston 13 and a second partial piston 14, is put into its outset position via a restoring spring element 17 disposed in the control chamber 11. The filling of the compression chamber 15 is effected via the filling line 23, which extends from the nozzle control chamber 24 to the compression chamber 15 and contains a check valve 34.

As a result of the pressure level prevailing in the nozzle control chamber 24 and corresponding to the pressure level inside the high-pressure storage chamber 2, a hydraulic closing force is exerted on one face end 27 of the injection valve member 26 and is additionally reinforced by the closing force of a closing spring 28 that is likewise received in the nozzle control chamber 24. In this arrangement, a constant presence of the pressure level prevailing in the high-pressure storage chamber 2 is possible in the nozzle chamber 22, without unwanted opening of the injection valve member 26 that would uncover the injection openings 33 to the combustion chamber 7.

In the position of the piston 12 of the pressure booster 5 shown in FIG. 2, that is, in the deactivated state of the pressure booster, the compression chamber 15 of the pressure booster 5 is not acted upon by the second partial piston 14 of the piston 12, so that the fuel inlet 21 to the nozzle chamber 22 inside the injector body 4 of the fuel injector 1 is acted upon solely by the pressure level prevailing in the high-pressure storage chamber 2. However, this does not suffice to open the injection valve member 26 from its seat toward the combustion chamber by generation of a hydraulic force on the pressure shoulder 30 and to trip an injection of fuel, via the injection openings 33, into the combustion chamber 7 of the self-igniting internal combustion engine.

The pressure relief valve 40 integrated with the control line 20, 49 between the metering valve 6 and the control chamber 11 includes a substantially cylindrical valve body 43. The cylindrical valve body 43 is penetrated by a through bore 44. The through bore 44 connects the first chamber 41 to the second chamber 42 of the pressure relief valve 40. In the position of the valve body 43 of the pressure relief valve 40 shown in FIG. 2, its valve member 45 is uncovered by a slide portion 46 which has moved into the second chamber 42. The essentially cylindrical valve body 43 can include a constriction 50. A valve spring 48 is received in the first chamber 41 of the pressure relief valve 40 and acts upon an upper face end of the valve body 43. Through the opened slide seat 46 of the valve body 43 of the pressure relief valve 40, the work chamber 10 and the second chamber 42 of the pressure relief valve 40 communicate with the control chamber 11 of the pressure booster 5 via the control line 20; in these chambers, the same pressure level prevails.

Figure 3:
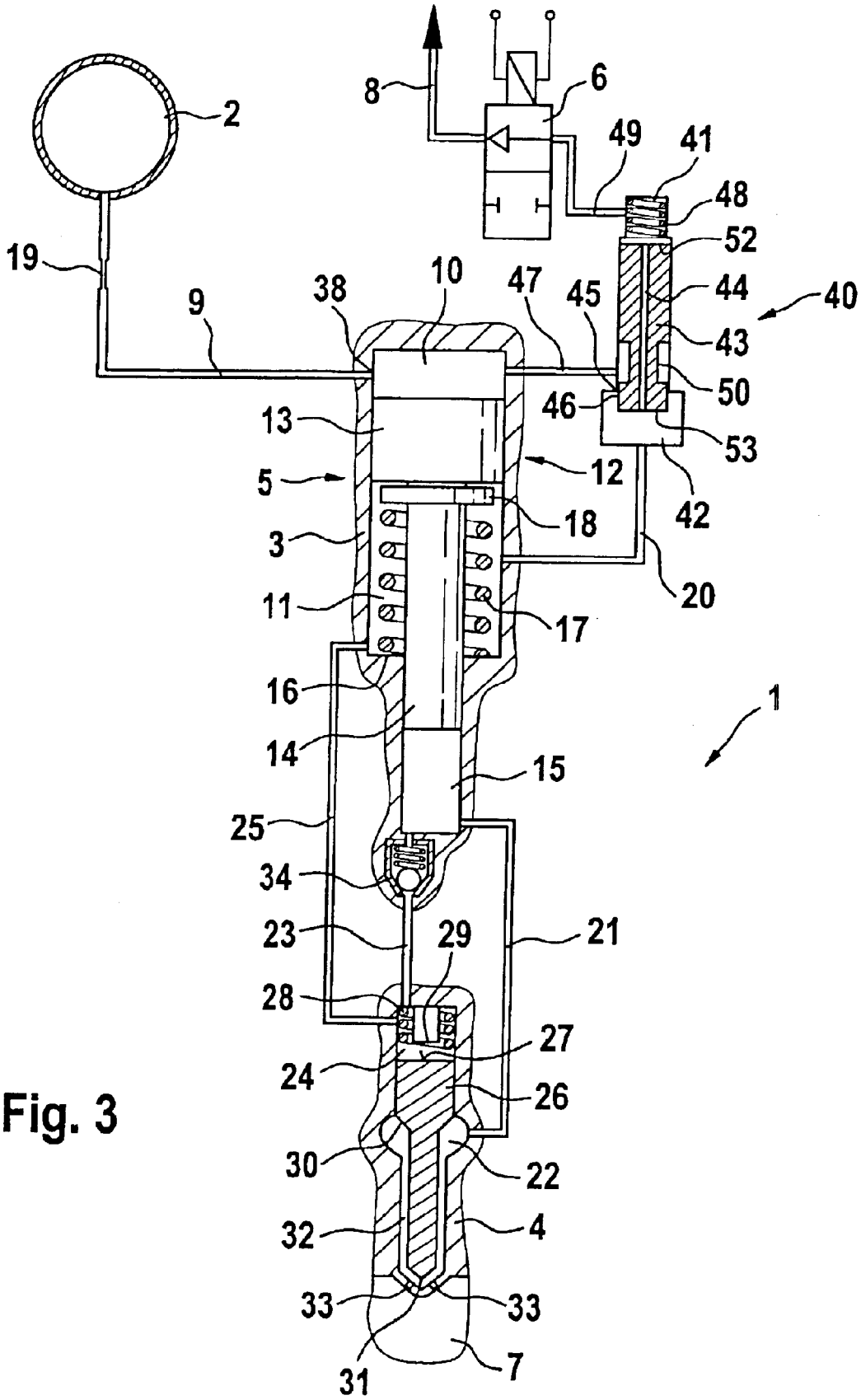
FIG. 3, the pressure-boosted fuel injector of FIG. 2 in the activated state.

FIG. 3 shows the pressure-boosting fuel injector of FIG. 2 in the activated state, that is, with the 2/2-way valve triggered.

The metering of the fuel is effected by triggering the metering valve 6, which is preferably embodied as a 2/2-way valve. This valve can be triggered either via a piezoelectric actuator or via a magnetic actuator; the metering valve 6 can also be embodied as a servo valve or as a directly triggered valve. Triggering the metering valve 6 causes the first chamber 41 of the pressure relief valve 40 to communicate with the low-pressure-side return 8. The valve body 43 of the pressure relief valve 40, with its slide portion 46, closes the valve cross section 45 by moving inward, counter to the action of the valve spring 48, in the direction of the first chamber 41. As a result, the overflow line 47 between the work chamber 10 of the pressure booster 5 and the second chamber 42 of the pressure relief valve 40 is closed. This brings about a separation of the control chamber 11 of the pressure booster 5 from the system pressure supply, that is, from the high-pressure storage chamber 2 (common rail).

The pressure relief of the control chamber 11 is now effected via the control line 20 into the second chamber 42 of the pressure relief valve 40 and via the through bore 44, embodied in the valve body 43, into the low-pressure-side return 8. By the drop in the pressure level in the control chamber 11 of the pressure booster 5, the pressure booster 5 is activated, because the piston 12, in this case embodied in two parts, now moves into the compression chamber 15 of the pressure booster 5 as a result of the higher pressure level now prevailing in the work chamber 10. Because of the fluidic communication between the compression chamber 15 and the nozzle chamber 22 in the nozzle body 4 via the fuel inlet 21, the pressure also rises in the nozzle chamber 22, which surrounds the injection valve member 26. Thus a pressure force acting in the opening direction of the injection valve member 26 is established at the pressure shoulder 30 of the injection valve member 26. Simultaneously, upon activation of the metering valve 6, the pressure in the nozzle control chamber 24 decreases, and as a result the pressure force in the closing direction on the face end 27 of the injection valve member 26 also lessens. The injection valve member 26, embodied for instance as a nozzle needle, opens as a result of the hydraulic force in the nozzle chamber 22 prevailing at the pressure shoulder 30. The opening is accordingly done under pressure control, so that fuel from the nozzle chamber 22 flows via the annular gap 32 surrounding the injection valve member 26 in the direction of the tip 31 of the injection valve member 26, and from there, via the injection openings 33, it reaches the combustion chamber 7 of the self-igniting internal combustion engine.

As long as the control chamber 11 of the pressure booster 5 remains pressure-relieved, or in other words as long as the pressure booster 5 is activated, a very high pressure prevails in its compression chamber 15. The highly compressed fuel flows from the compression chamber 15 via the fuel inlet 21 to the nozzle chamber 22, and from there via the aforementioned annular gap 32 in the direction of the injection openings 33. The fuel, positively displaced from the control chamber 11 by the inward motion of the piston 12, or in the variant embodiment shown in FIG. 3 the inward motion of the second partial piston 14, into the control chamber flows into the low-pressure-side return via the pressure relief valve 40, or in other words the through bore 44 of that valve. The flow cross section inside the flow conduit 44, which penetrates the valve body 43 of the pressure relief valve 40, is designed such that an adequate pressure difference between the first chamber 41 and the second chamber 42 of the pressure relief valve 40 is established, which keeps the valve body 43 of the pressure relief valve 40 in the closed position, or in other words keeps its slide portion 46 in coincidence with the valve cross section 45, so that the overflow line 47 into the pressure chamber 10 of the pressure booster remains closed off.

To terminate the injection, renewed triggering of the metering valve 6 embodied as a 2/2-way valve separates the control chamber 11 of the pressure booster 5 from the low-pressure-side return and causes it to communicate again with the high pressure level prevailing in the high-pressure storage chamber 2 (common rail). This is effected by closing the metering valve 6 embodied as a 2/2-way valve. The communication with the low-pressure-side return 8 is interrupted, and as a result the fuel flow through the flow conduit 44 in the valve body 43 of the pressure relief valve 40 comes to a stop. Thus a pressure difference between the first chamber 41 and the second chamber 42 of the pressure relief valve 40 that would be operative in the closing direction cannot develop. By means of the valve spring 48 disposed in the first chamber 41, the valve body 43 is pressed with its second face 43 and the adjoining slide portion 46 on the valve body 43 into the second chamber 42 of the pressure relief valve 40. The slide portion 46 moves out of the valve cross section 45 as a consequence, so that the pressure level, corresponding to the pressure in the high-pressure storage chamber 2, that prevails in the work chamber 10 of the pressure booster 5 prevails again at the control chamber 11 of the pressure booster 5 via the overflow line 47, the second chamber 42, and the control line 20. Because of the pressure equilibrium that has been brought about, the piston 12 of the pressure booster 5 moves into the work chamber 10, and its inward motion is reinforced by the restoring spring element 17 disposed in the control chamber 11. As a result of this inward motion, the pressure level inside the compression chamber 15 of the pressure booster 5 is rapidly reduced to the pressure level prevailing in the high-pressure storage chamber 2. Since in the nozzle control chamber 24 the pressure level prevailing in the high-pressure storage chamber 2 now also prevails via the connecting line 25, the injection valve member 26, configured for instance as a nozzle needle, is hydraulically balanced; that is, the pressure level is identical in both the nozzle chamber 22 and the nozzle control chamber 24. The closing force which is exerted on the face end 27 of the injection valve member 26 by the closing spring element 28 predominates and causes a closing of the injection valve member 26, or in other words its motion into its seat toward the combustion chamber. As a result, the injection openings 33 in the region of the tip 31 of the injection valve member 26 are closed, and the injection is terminated.

After the pressure equilibrium inside the injection system, in the configuration shown in FIG. 3, the pressure booster piston 12 is restored to its outset position by the restoring spring 17 acting on it. Refilling of the compression chamber 15 is effected from the nozzle control chamber 24, via the filling line 23 with the integrated check valve 34. The compression chamber 15 could also be filled from either of the hydraulic chambers 11 or 10.

The nozzle control chamber 24 is in turn filled with fuel via the control chamber 11 of the pressure booster 5 by way of the connecting line 25. The fuel flows into the control chamber 11 of the pressure booster 5 again via the work chamber 10 of the pressure booster 5 by way of the overflow line 47, the second chamber 42 of the pressure relief valve 40, and the control line 20. As a result of the refilling, or in other words the volumetric equilibrium of the fuel quantity injected into the combustion chamber 7 via the injection openings 33 at the seat toward the combustion chamber of the injection valve member 26, the components listed are thoroughly rinsed, and the fuel volume injected into the combustion chamber 7 of the self-igniting internal combustion engine is replaced.

The metering valve identified by reference numeral 6 is preferably embodied as a 2/2-way valve and can be produced especially simply in terms of production technology to the requisite tolerances. The metering valve 6 preferably designed as a 2/2-way valve can be embodied as either a directly actuated valve or as a servo valve. The triggering of the 2/2-way metering valve 6 can be done by either a magnetic actuator or a piezoelectric actuator. However, a valve can also be used which arrows controlling the flow cross section of the control line 49 to the return 8. The pressure relief valve 40 can advantageously be designed such that there is no hydraulic pressure face opposite the pressure prevailing in the overflow line 47. Thus the valve can be moved by means of a slight spring force and a slight pressure difference between the chamber 42 and the chamber 41, and only slight throttling of the diversion quantity in the bore 44 is necessary. To optimize the switching performance, a throttle restriction can also be disposed in the overflow line 47.

In a modification of the layout shown in FIG. 3 for the system for injecting fuel into the combustion chamber 7 of a self-igniting internal combustion engine, the nozzle control chamber 24, instead of the control chamber 11 of the pressure booster 5, can communicate via the connecting line 25 with the injector inlet, for instance by way of the work chamber of the pressure booster. As already noted, the piston 12 can be embodied as either a one-piece or two-part component inside the pressure booster and can contain a first partial piston 13 and a second partial piston 14, which can in turn be embodied in either one piece or multiple parts each.

Figure 4:
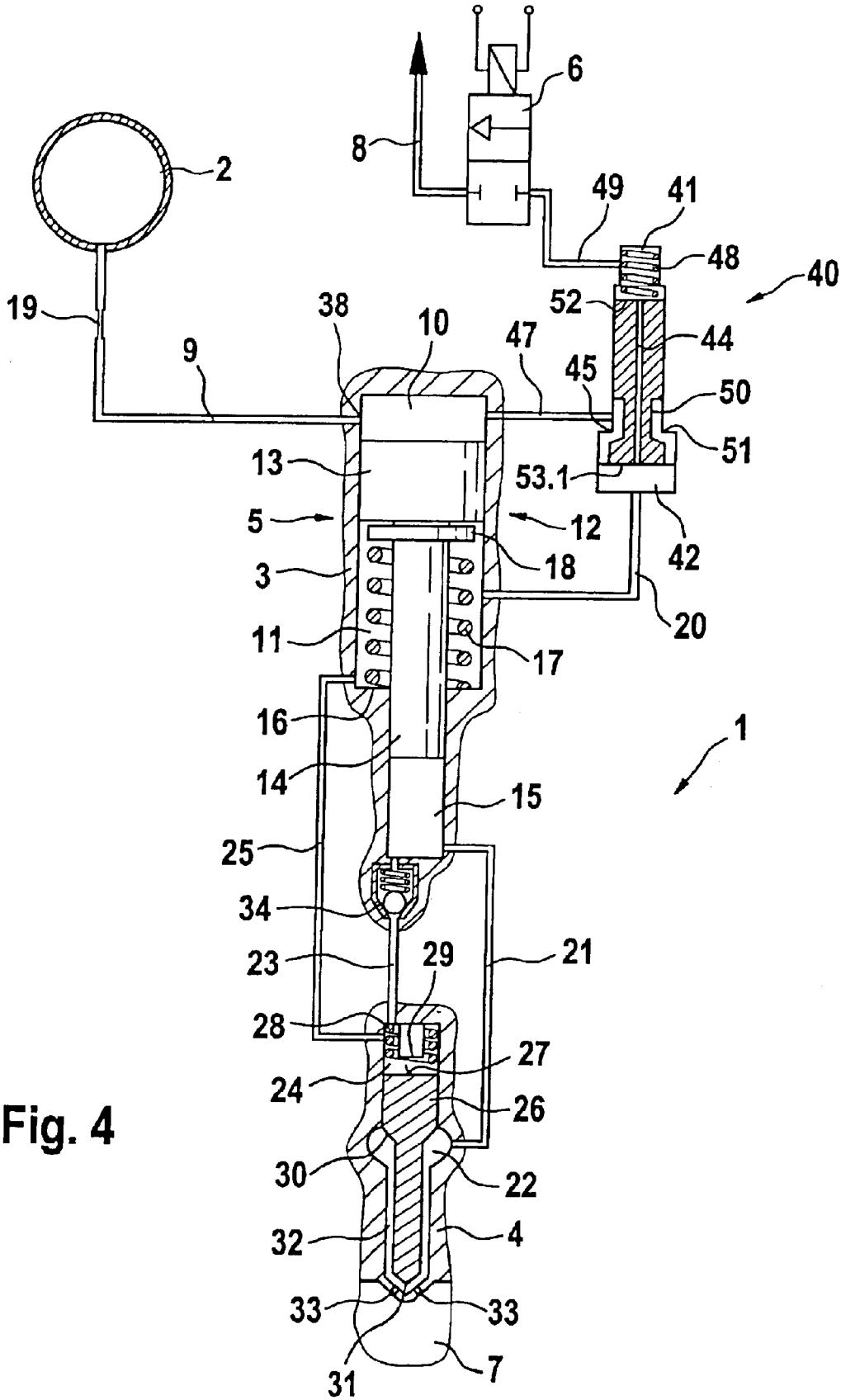
FIG. 4, the pressure-boosted fuel injector of FIG. 2, with a relief valve and a sealing seat.

FIG. 4 shows the pressure-boosted fuel injector as in FIG. 2, with a relief valve with a sealing seat.

Unlike the view of the pressure relief valve 40 in FIGS. 2 and 3, in the pressure relief valve shown in FIG. 4 the valve body 43 includes a mushroom-shaped shoulder. Instead of a slide portion 46 on the lower face end 53 of the valve body 43 with the flow conduit 44 (compare FIG. 3), a mushroom-shaped attachment is formed onto the lower end of the valve body 43 in the view in FIG. 4 and forms a sealing seat 51 with the valve cross section 45. An end face 53.1 in the lower region of the valve body 43 is embodied with a greater diameter than the face end 52 of the valve body 43 opposite the first chamber 41 of the pressure relief valve 40. Because of the through bore 44 penetrating the valve body 43, in the variant embodiment in FIG. 4 a pressure difference can be attained between the first chamber 41 and the second chamber 42 of the pressure relief valve 40, and this difference keeps the valve body 43 in its closed position when there is a flow through the flow conduit 44, once the metering valve 6 embodied as a 2/2-way valve has been activated or in other words opened. The other components of the fuel injector 1 shown in FIG. 4 substantially correspond to the components already described in conjunction with FIGS. 2 and 3, and to avoid repetition will not be further explained in conjunction with FIG. 4.

Figure 5:
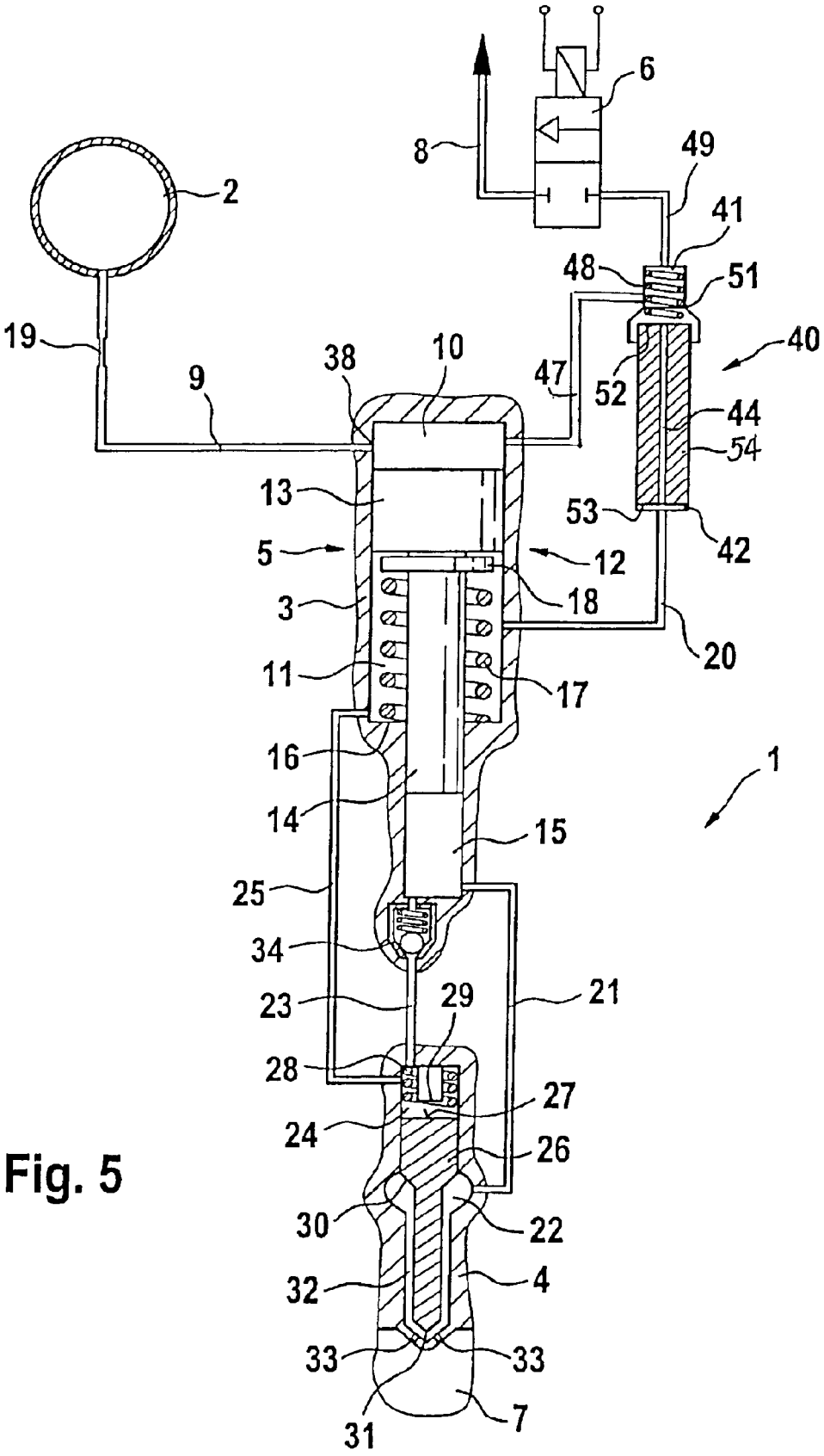
FIG. 5, the pressure-boosted fuel injector shown in FIG. 2, with a relief valve with a cylindrically embodied valve body.

FIG. 5 shows the pressure-boosted fuel injector in the same view as FIG. 2, with a pressure relief valve whose valve body is embodied essentially cylindrically.

The system for injecting fuel shown in FIG. 5 includes the fuel injector 1, which contains a metering valve 6 embodied as a 2/2-way valve; the pressure booster 5, received in the injector body 3; and the injection valve 26, which is received in the nozzle body 4. Via a high-pressure storage chamber 2 (common rail), the fuel injector 1 is supplied with fuel at high pressure via the supply line 9. The supply line 9 can contain a throttle restriction 19, which serves to damp pressure pulsations or pressure wave reflections into the interior of the high-pressure storage chamber 2, in order to protect it against excessively high peak pressure loads. The supply line 9 from the high-pressure storage chamber 2 (common rail) discharges at a discharge point 38 into the work chamber 10 of the pressure booster 5. The work chamber 10 and the control chamber 11 of the pressure booster 5 are separated from one another by a piston 12, which can include a first partial piston 13 and a second partial piston 14. The piston 12 of the pressure booster 5 can be in either one part or multiple parts and is acted upon by a spring element 17 disposed in the control chamber 11. The spring element 17 is braced on one end on the abutment 16, formed by the bottom of the control chamber 10, and on the other on a stop face 18 in the upper region of the second partial piston 14. The second partial piston 14 of the piston 12, with its lower end face, acts upon the compression chamber 15 of the pressure booster 5. From the compression chamber 15, the fuel inlet 21 leads to the nozzle chamber 22, which surrounds the injection valve member 26 in the region of a pressure shoulder 30 embodied on the injection valve member. A connecting line 25 extends from the control chamber 11 of the pressure booster 5 and discharges into the nozzle control chamber 24 of the nozzle body 4. From the nozzle control chamber 24, a filling line 23 (filling path) with a check valve 34 integrated with it extends to the compression chamber 15 of the pressure booster 5, and by way of it the compression chamber 15 is filled with fuel from the nozzle control chamber 24. A stroke stop 29 is embodied inside the nozzle control chamber 24; it defines the maximum stroke of the injection valve member 26, embodied for instance as a nozzle needle, and strikes against the top end face 27 thereof. A closing spring 28 is also received in the nozzle control chamber 24; it acts upon the face end 27 of the injection valve member 26. From the nozzle chamber 22 inside the nozzle body 4, the annular gap 32, surrounding a narrowed region of the injection valve member 26, extends as far as the tip 31 of the injection valve member 26. When the injection valve member 26 is in its seat toward the combustion chamber, the injection openings 33, by way of which the fuel that is at high pressure is injected into the combustion chamber 7 of the self-igniting internal combustion engine, are closed.

From the control chamber 11 of the pressure booster 5, the control line 20 extends to the pressure relief valve 40, which is also included in this variant embodiment of the version proposed according to the invention. Unlike the pressure relief valve 40 shown in FIGS. 2, 3 and 4, the pressure relief valve 40 shown in FIG. 5 has a substantially cylindrical valve body 54. The cylindrical valve body 54 is penetrated by a flow conduit 44, which extends between the first chamber 41 and the second chamber 42 of the pressure relief valve 40. The cylindrical valve body 54 moves with its first face end 52 into the first chamber 41, while the second face end 53 of the cylindrical valve body 54 is associated with the second chamber 42 of the pressure relief valve 40. In a distinction from the variant embodiments that are shown in FIGS. 2, 3 and 4, the overflow line 47 between the work chamber 10 of the pressure booster 5 and the pressure relief valve 40 of the variant embodiment of FIG. 5 discharges into the first chamber 41 of the pressure relief valve 40. In the variant embodiment of the pressure relief valve 40 shown in FIG. 5, the sealing seat 51, which connects and separates the control chamber of the pressure booster 5 to and from the work chamber 10 of the pressure booster, is located on the side of the pressure relief valve 40 toward the metering valve 6. The mode of operation of the pressure relief valve 40 shown in FIG. 5 is essentially equivalent to the mode of operation of the system for injecting fuel shown in FIG. 2.

If the metering valve, embodied preferably as a 2/2-way valve, is opened, then the pressure relief valve 40 closes. As a result of the pressure difference established between the second chamber 42 and the first chamber 41 of the pressure relief valve 40 when there is a flow through the flow conduit 44, the cylindrical valve body 54 is kept in its closed position. After the closure of the metering valve 6, conversely, the pressure relief valve 40 opens, because of the valve spring 48 disposed in the first chamber 41 and causes the control chamber 11 of the pressure booster 5, via the control line 20, the second chamber 42, and the flow conduit 44, to communicate with the first chamber 41 of the pressure relief valve and from there, via the overflow line 47 discharging into it, with the work chamber 10 of the pressure booster. As a result, the second partial piston 14 very quickly moves out of the compression chamber 15, and the outward motion is reinforced by the restoring spring 17 disposed in the control chamber 11. As a result, the pressure in the nozzle chamber 22 inside the nozzle body 4 drops very rapidly. Consequently, the opening force acting on the pressure shoulder 30 of the injection valve member 26 decreases very sharply, so that via the closing spring 28, which is disposed in the nozzle control chamber 24 and acts on the face end 27 of the injection valve member 26, the injection valve member 26 is pressed into its seat toward the combustion chamber, and the injection openings 33 into the combustion chamber 7 are closed.

The foregoing relates to preferred exemplary embodiments of the invention, it being understood that other variants and embodiments thereof are possible within the spirit and scope of the invention, the latter being defined by the appended claims.

What is claimed is:

1. A device for injecting fuel into the combustion chamber (7) of an internal combustion engine, comprising a high-pressure source (2), a pressure booster (5) including a compression chamber (15), a metering valve (6), the pressure booster (5) including a work chamber (10) and a control chamber (11) which are separated from one another by a movable piston (12; 13,14), a change in pressure in the control chamber (11) of the pressure booster (5) causing a change in pressure in the compression chamber (15) of the pressure booster (5) via an inlet (21) which acts upon a nozzle chamber (22) surrounding an injection valve member (26), and a pressure relief valve (40) with a valve body (43, 54) disposed in a control line (20, 49) between the control chamber (11) of the pressure booster (5) and the metering valve (6), the metering valve controlling fluid pressure acting upon at least one hydraulic chamber (41, 42) of the pressure relief valve (40), to thereby allow said chamber to communicate with the pressure prevailing in the high-pressure storage chamber (2).

2. The device of claim 1, further comprising an overflow line (47) disposed between the pressure relief valve (40) and the pressure booster (5).

3. The device of claim 2, wherein the overflow line (47) discharges into the work chamber (10) of the pressure booster (5).

4. The device of claim 1, wherein the valve body (43) of the pressure relief valve (40) comprises a flow conduit (44) extending essentially parallel to the direction of the control line (20, 49).

5. The device of claim 1, wherein the valve body (43) comprises a slide portion (46) opening/closing the valve cross section (45) of the pressure relief valve (40).

6. The device of claim 1, wherein the valve body (43) comprises a region (50) of reduced diameter between its face ends (52, 53).

7. The device of claim 2, wherein the valve body (43) comprises a region (50) of reduced diameter between its face ends (52, 53), and wherein the overflow line (47) between the pressure booster (5) and the pressure relief valve (40) discharges at the valve body (43), inside the region (50) of reduced diameter.

8. The device of claim 1, further comprising a valve spring (48) urging the valve body (43) of the pressure relief valve (40) in the opening direction.

9. The device of claim 4, wherein the flow cross section of the flow conduit (44) in the valve body (43, 54) is dimensioned such that between a first chamber (41) and a second chamber (42) of the pressure relief valve (40), a pressure difference is established which keeps the valve body (43, 54) in the closed position.

10. The device of claim 2, wherein the overflow line (47) between the pressure booster (5) and the pressure relief valve (40) discharges inside a first chamber (41), which is disposed on the side of the pressure relief valve (40) oriented toward the metering valve (6).

11. The device of claim 1, wherein the valve body (54) is embodied as a cylinder penetrated by a flow conduit (44).

12. The device of claim 11, wherein one face end (52) of the valve body (54) opens/closes a sealing seat (51) in one of the chambers (41, 42) of the pressure relief valve (40).

13. The device of claim 1, wherein the valve body (43) of the pressure relief valve (40) comprises a flow conduit (44) extending essentially parallel to the direction of the control line (20, 49), wherein the flow cross section of the flow conduit (44) in the valve body (43, 54) is dimensioned such that between a first chamber (41) and a second chamber (42) of the pressure relief valve (40), a pressure difference is established which keeps the valve body (43, 54) in the closed position, and wherein upon opening of the metering valve (6) toward the low-pressure-side return (8), the valve body (43, 54) of the pressure relief valve (40) closes, and the pressure difference between the first chamber (41) and the second chamber (42), established via the flow conduit (44), keeps the valve body (43, 54) in the closed position.

14. The device of claim 1, further comprising an overflow line (47) disposed between the pressure relief valve (40) and the pressure booster (5), wherein upon closure of the metering valve (6), the valve body (43, 54) of the pressure relief valve (40) opens under spring action, and the control chamber (11) of the pressure booster (5), via the control line (20), the pressure relief valve (40), and the overflow line (47), is made to communicate with the pressure level prevailing in the high-pressure storage chamber (2), in order to bring about a rapid depressurization in the nozzle chamber (22) of the nozzle body (4).

15. The device of claim 1, wherein the compression chamber (15) of the pressure booster (5) can be filled with pressure from the nozzle control chamber (24) in the nozzle body (4) via a filling path (23).

16. The device of claim 15, further comprising a check valve (34) received in the filling path (23) to the compression chamber (15) of the pressure booster (5).

* * * * *